US005475907A

United States Patent [19]

Hoover

[11] Patent Number: 5,475,907

[45] Date of Patent: Dec. 19, 1995

[54] APPARATUS AND METHOD FOR FORMING COILS OF YARN AND FOR HEAT SETTING THE SAME

[75] Inventor: Donald L. Hoover, Cramerton, N.C.

[73] Assignee: American Line Corporation, Gastonia, N.C.

[21] Appl. No.: 434,945

[22] Filed: May 4, 1995

Related U.S. Application Data

[63] Continuation-in-part of Ser. No. 289,937, Aug. 12, 1994.

[51] Int. Cl.[6] ..... D02G 1/00; D02J 1/02; B65H 54/00; B65H 51/02

[52] U.S. Cl. ..... 28/219; 28/289; 226/97; 226/108

[58] Field of Search ..... 28/219, 221, 266, 28/289, 101; 242/361, 361.4, 363; 226/97, 108

[56] References Cited

U.S. PATENT DOCUMENTS

| | | | |
|---|---|---|---|
| 2,982,000 | 5/1961 | Gonsalves . | |
| 3,270,977 | 9/1966 | Tillou et al. | 242/361 |
| 3,469,796 | 9/1969 | Russell et al. | 28/289 X |
| 3,470,587 | 10/1969 | Kincaid . | |
| 3,618,184 | 11/1971 | Pearce et al. . | |
| 3,644,968 | 2/1972 | Elliott et al. . | |
| 3,667,092 | 6/1972 | Engels . | |
| 3,964,691 | 6/1976 | Pearce et al. . | |
| 4,069,566 | 1/1978 | Sumitomo et al. | 226/97 X |
| 4,085,881 | 4/1978 | Roberson | 226/97 X |
| 4,089,720 | 5/1978 | Haley . | |
| 4,185,064 | 1/1980 | Schippers | 28/289 X |
| 4,221,345 | 9/1980 | Schippers et al. . | |
| 4,318,206 | 3/1982 | Ferri et al. . | |
| 4,372,010 | 2/1983 | Gauvain . | |
| 4,408,378 | 10/1983 | Ketteringham et al. . | |
| 4,700,538 | 10/1987 | Varga et al. . | |
| 4,773,607 | 9/1988 | Missout et al. . | |
| 4,784,344 | 11/1988 | Lenk et al. | 226/97 X |
| 4,785,510 | 11/1988 | Astour | 28/289 |
| 4,817,880 | 4/1988 | Lenk et al. | 226/97 X |
| 4,825,630 | 5/1989 | Czelusniak, Jr. et al. . | |
| 4,833,872 | 5/1989 | Czelusniuk, Jr. et al. . | |
| 4,967,449 | 11/1990 | Gasser . | |
| 5,024,390 | 6/1991 | Enderlin . | |
| 5,287,598 | 2/1994 | Günter et al. . | |

FOREIGN PATENT DOCUMENTS

| | | | |
|---|---|---|---|
| 1602027 | 11/1970 | France | 28/289 |
| 2381705 | 10/1978 | France | 28/289 |

*Primary Examiner*—John J. Calvert
*Attorney, Agent, or Firm*—Bell, Seltzer, Park & Gibson

[57] ABSTRACT

An apparatus and method are provided for forming coils of yarn and for heat setting the yarn. The apparatus has a coiler adapted to receive yarn from a yarn source ant to form the yarn into a plurality of loops of a desired size. The coiler preferably includes a supporting frame, a pair of feed rolls mounted on the supporting frame and adapted for feeding yarn from the yarn source, and a rotatable coiler tube positioned downstream from the feed rolls. An air blowing device is positioned between the feed rolls and the coiler tube for facilitating the advance of the yarn into and through the coiler tube. A first variable speed drive is connected to the pair of feed rolls and a second variable speed drive is connected to the coiler tube for rotating the coiler tube at a selected speed to thereby form loops of yarn of a desired size. The apparatus further has a conveyor positioned below the rotatable coiler tube for receiving overlapping loops of yarn thereon, and the conveyor extends through an enclosed heating oven for heat setting the loops of yarn carried thereon.

12 Claims, 4 Drawing Sheets

APPARATUS AND METHOD FOR FORMING COILS OF YARN AND FOR HEAT SETTING THE SAME

CROSS REFERENCE TO RELATED APPLICATIONS

This application is a continuation in part of copending application Ser. No. 08/289,937 filed Aug. 12, 1994, the disclosure of which is expressly incorporated herein by reference.

FIELD OF THE INVENTION

This invention relates to an apparatus and method for forming coils of yarn and, more particularly, to an apparatus for forming coils of yarn and for feeding the yarn into a heat treatment zone to thereby heat set the yarn.

BACKGROUND OF THE INVENTION

During the production of continuous filamentary or spun yarns, for example, the yarns are often conventionally subjected to a drawing or stretching process under tension. This stretching process is followed by a partial or complete relaxing of the yarn to produce the desired physical characteristics, such as a reduced shrinkage propensity in the processed yarn or some other effect, i.e., bulking or crimping of the filaments forming the yarn. Such yarns may have an inherent tendency to retract into a crimped form under low tension. Heat may also be used to assist this process.

Conventionally, the relaxation of yarn has been accomplished by a type of batch process wherein the yarn is temporarily collected in some form of can or box which allows a degree of contraction to take place such as seen in U.S. Pat. No. 3,470,587 by Kincaid titled "*Planetary Coiler*." Other processes are also known such as continuously subjecting the fed yarn to treatment with a hot fluid in some form of jet device such as seen in U.S. Pat. No. 3,644,968 by Elliott et al. titled "*Apparatus For Relaxing Yarns*." These prior methods, however, involve a relatively slow batch process, primarily provide only one pattern or type of crimp in the yarn, provide limited production output, and provide little control over the production process.

OBJECT AND SUMMARY OF THE INVENTION

Copending application Ser. No. 08/289,937 discloses an apparatus and method for coiling a yarn and then heat treating the coiled yarn, which effectively overcomes the disadvantages and limitations of the prior art practices as noted above, and it is an object of the present invention to provide a further improvement for such apparatus and method.

It is a more specific object of the present invention to provide an apparatus and method of coiling and then heat treating a yarn, which permits the yarn to be reliably advanced through a rotating coiler tube and without risk of jamming in the tube.

The above and other objects and advantages of the present invention are achieved in the embodiment described herein by the provision of an apparatus and method for forming coils of yarn, and which comprises a supporting frame, a pair of feed rolls mounted to the supporting frame and arranged to feed yarn in a downward direction from a yarn source, and a rotatable coiler tube positioned adjacent and below the pair of feed rolls. The rotatable coiler tube is vertically positioned and arranged to facilitate the travel of yarn from the feed rolls to and through the coiler tube. Also, an air blowing device is vertically positioned between the feed rolls and the rotatable coiler tube, and the air blowing device includes a guide tube having an upper portion positioned closely adjacent the feed rolls and a lower portion positioned coaxially within the upper confines of the rotatable coiler tube. An air supply duct communicates with the interior of the guide tube at a medial location along its length and so that the introduced air exhausts from the lower portion of the guide tube and into the rotatable coiler tube to thereby assist in the movement and guiding of the yarn from the feed rolls to and through said rotatable coiler tube.

The apparatus of the present invention further includes a first variable speed drive connected to the pair of feed rolls and arranged to rotate the feed rolls at a predetermined speed, and a second variable speed drive connected to the rotatable coiler tube and arranged to rotate the same at a speed so as to form a plurality of loops of yarn.

A conveyor is positioned below the rotatable coiler tube and is adapted to receive the loops of yarn from the coiler tube, and an enclosed oven is positioned downstream of the coiler tube and receives a portion of the conveyor therein for heating the loops of yarn carried on the conveyor so as to effect heat setting of the yarn while in the looped condition.

The present invention also involves a method of heat setting a yarn while the yarn is supported in overlapping coils, which includes the steps of advancing the yarn along a path of travel from a yarn supply source to an advancing conveyor belt, and including passing the advancing yarn serially (1) between cooperating feed rolls so that the yarn advances downwardly therefrom, (2) through a vertically disposed air blowing device, and (3) through a vertically disposed and rotating coiler tube which forms overlapping coils of the yarn on the advancing conveyor belt. The conveyor belt advances through a heat setting oven so as to heat set the yarn which is disposed upon said belt.

BRIEF DESCRIPTION OF THE DRAWINGS

Some of the objects and advantages of the present invention having been stated, others will become apparent as the description proceeds when taken in conjunction with the accompanying drawings, in which.

DETAILED DESCRIPTION OF THE PREFERRED EMBODIMENT

The present invention now will be described more fully hereinafter with reference to the accompanying drawings in which a preferred embodiment of the invention is shown. This invention may, however, be embodied in many different forms and should not be construed as limited to the illustrated embodiments set forth herein; rather, the illustrated embodiment is provided so that this disclosure will be thorough and complete and will fully convey the scope of the invention to those skilled in the art. Like numbers refer to like elements throughout.

Figure 1:
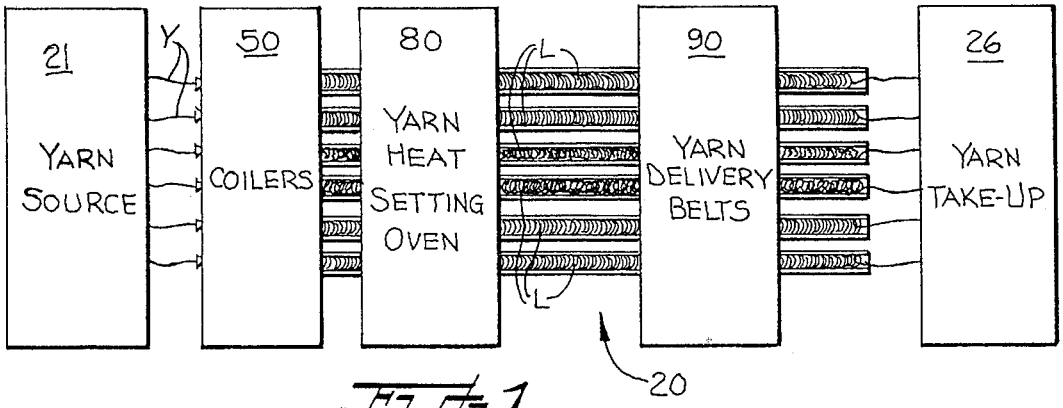
FIG. 1 schematically illustrates a top plan view of an apparatus having a plurality of coilers for forming coils of yarn and feeding the yarn into and through an enclosed heat setting oven according to the present invention.
Figure 2:
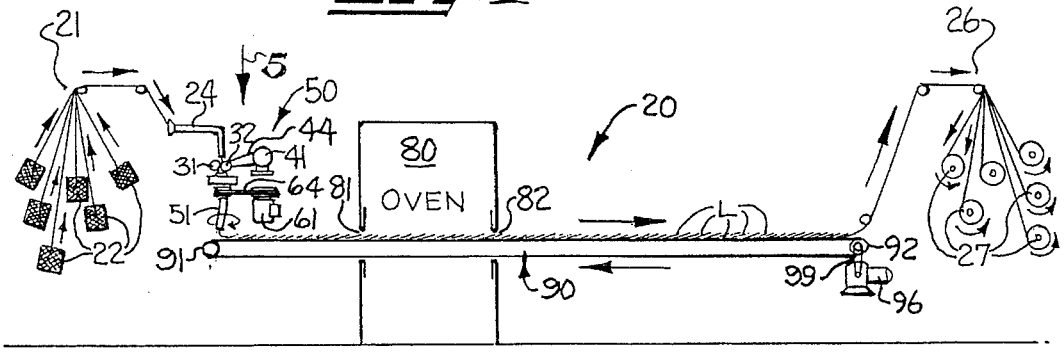
FIG. 2 schematically illustrates a side elevational view of an apparatus for forming coils of yarn and feeding the yarn into and through an enclosed heat setting oven according to the present invention.

FIGS. 1 and 2 schematically illustrate an apparatus, broadly designated at 20, for forming coils of yarn having a plurality of coilers 50 according to the present invention. FIG. 2 schematically illustrates a side plan view of an apparatus 20 for forming coils of yarn Y and for feeding the coiled yarn Y to a heating zone, shown in the form of an enclosed heat setting oven generally at 80, according to the present invention. FIG. 1 schematically illustrates in a top plan view an apparatus 20 according to the invention having a series of coilers, broadly designated at 50, positioned adjacent each other and yet, for example, sharing the same enclosed heating means for heating the yarn Y, i.e., the heat setting oven 80, such as in a production facility or the like. This type of configuration can be of particular interest where, for example, a high production output of the yarn Y is important to the user of the apparatus 20.

As also illustrated in FIGS. 1 and 2, the apparatus 20 preferably includes a yarn source 21 which is illustrated as a plurality of yarn supply packages 22 and which is positioned to feed yarn Y to be coiled to each of the respective coilers 50. Although the invention includes an apparatus having one or more coilers 50, the initial description herein will generally discuss an apparatus 20 having one coiler 50 and then describe an apparatus 20 having a plurality of coilers 50. The coiler 50 cooperates with the yarn source 21 and is adapted for forming coils in the supplied yarn Y. The preferred supply path and flow of the yarn Y to and through the coiler 50 and the heating oven 80 are schematically illustrated in FIG. 2 by the arrows. The supplied yarn Y preferably is either continuous filament yarn or spun yarn.

The apparatus 20 also preferably includes a conveyor 90 positioned below the coiler 50 that cooperates with the coiler 50 and the heat setting oven 80. The conveyor 90 is adapted for receiving loops L of yarn Y thereon and feeds the yarn Y from the coiler 50 to and through the enclosed heat setting oven 80. The yarn heat setting oven 80 is positioned downstream from the coiler 50 (FIG. 1) and receives portions of the conveyor 90 therein for heating the loops L of yarn Y carried thereon to thereby effect a heat setting treatment to the yarn Y. After the yarn Y passes through the heat setting oven 80 on portions of the conveyor 90, the yarn Y is preferably cooled by circulating air, such as with a fan, and/or exposure to air, other gases, or the like and taken-up by yarn take-up means, generally designated at 26, which is illustrated as a plurality of rollers and winders for individually winding the yarn Y to form individual packages 27 thereof. The yarn take-up means 26 preferably supplies the needed tension to take-up the yarn Y from the conveyor 90 in a smoothly operable manner so that entanglement or other problems do not occur when receiving the yarn Y.

Figure 5:
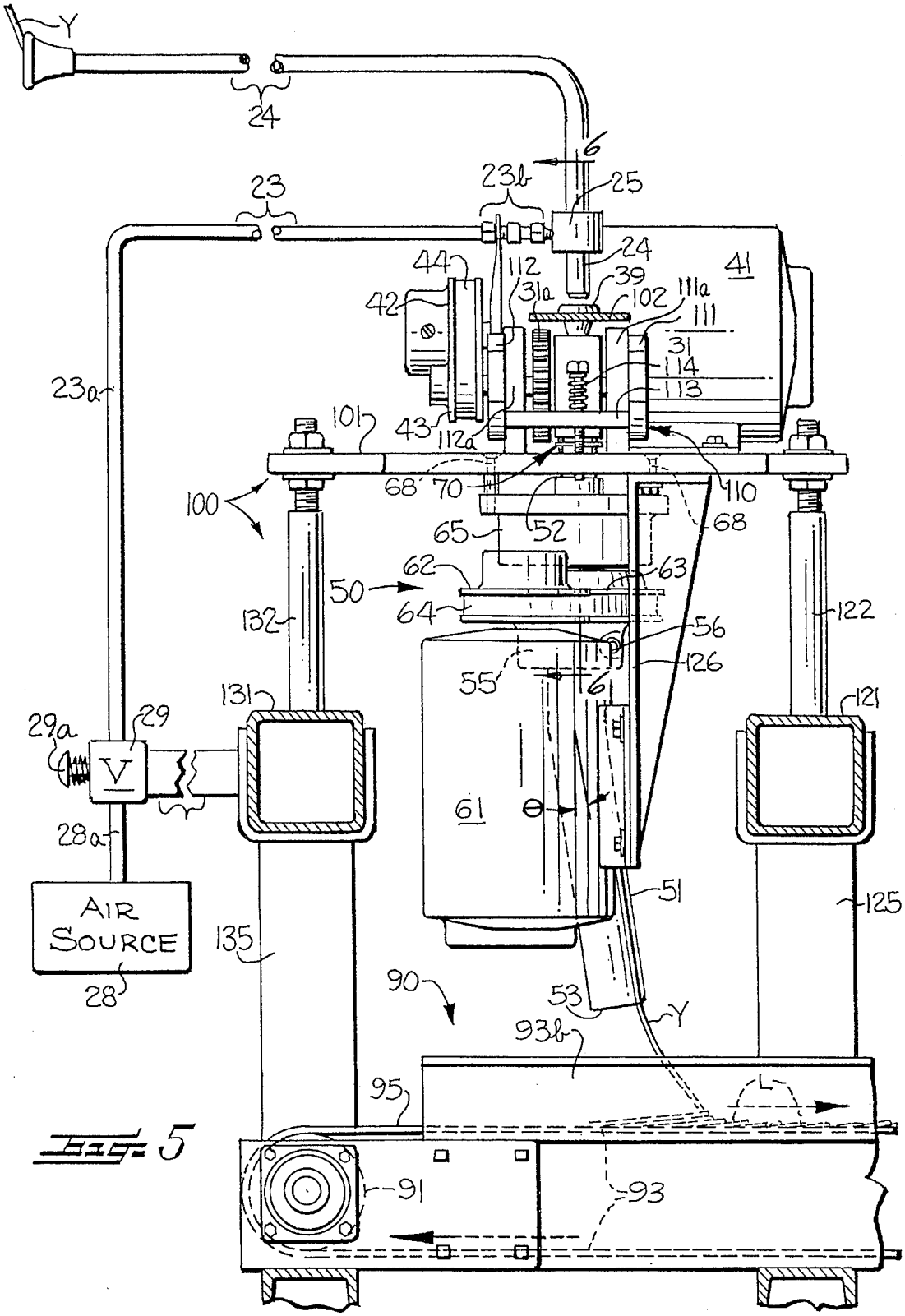
FIG. 5 is a more detailed fragmentary side elevational view of an apparatus for forming coils of yarn according to the present invention.
Figure 6:
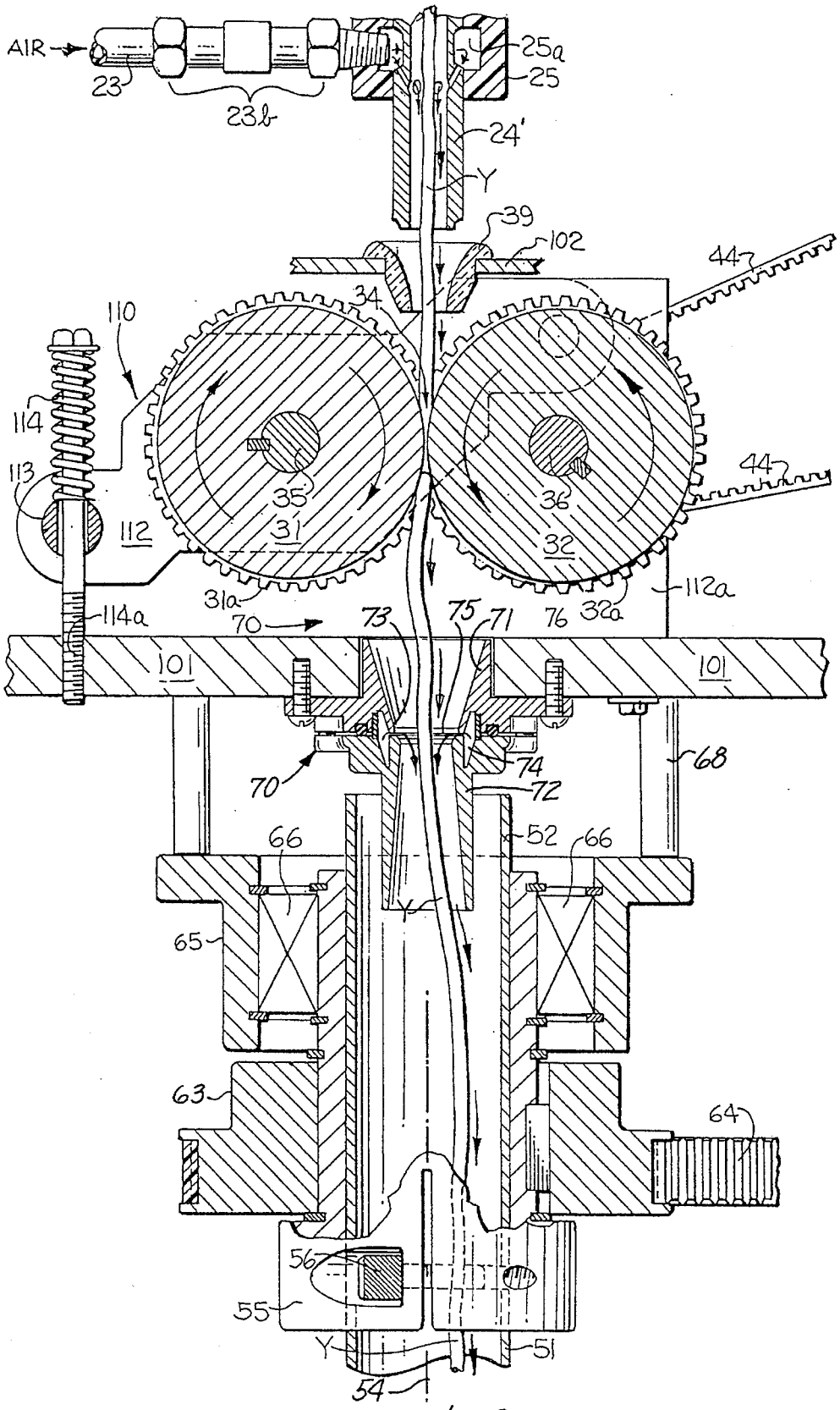
FIG. 6 is an enlarged fragmentary front elevational view of the apparatus for forming coils of yarn taken along line 6—6 of FIG. 5.
Figure 7:
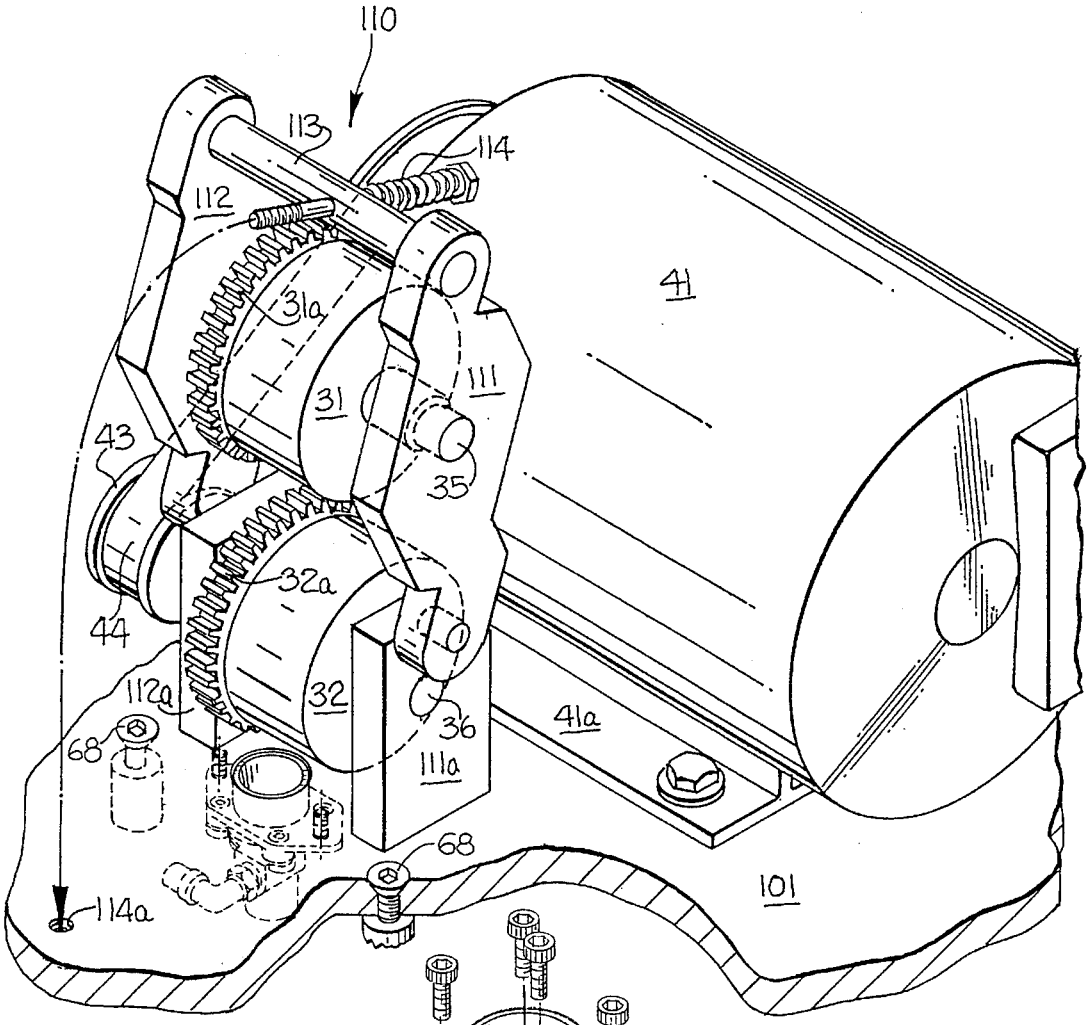
FIG. 7 is a fragmentary perspective view of the apparatus for forming coils of yarn, showing the feed rolls in their opened position.

As best illustrated in FIGS. 5–7, the coiler 50 of the apparatus 20 preferably includes a supporting plate 101 which is fixed to the frame of the apparatus, a pair of feed rolls 31, 32 mounted on the supporting plate 101 and adapted for feeding yarn Y from the yarn source 21, and a coiler tube 51, which is rotatable about a vertical axis 54 as best seen in FIG. 6, positioned below and cooperating with the pair of feed rolls 31, 32. The pair of feed rolls 31, 32 cooperate with the first yarn source 21 and the coiler tube 51 so as to feed the yarn Y supplied from the first yarn source 21 to the coiler tube 51 preferably by pneumatic means which preferably includes an elongate tube 24 or the like positioned upstream of the feed rolls 31, 32, and which forms an air jet nozzle 24' at its downstream end.

The air jet nozzle 24' is adapted for facilitating the thread up of yarn Y from the yarn supply packages 22 to the feed rolls 31, 32, and the nozzle has a downwardly directed output end positioned adjacent and immediately above the pair of feed rolls 31, 32, as best illustrated in FIGS. 5 and 6. The air jet nozzle as illustrated includes a tube collar 25 which defines an annular air chamber **25*a* (FIG. 6), and which communicates with each of several inclined bores leading to the interior bore of the tube. An air delivery tube 23 having first and second end portions 23*a*, 23*b* is connected by the second end portion 23*b* thereof to the collar 25 so as to operatively supply air from a compressed air source 28 to the air chamber 25*a* and into the nozzle. The air source 28 assists in drawing the yarn Y from the yarn source 21, through the elongate tube 24, and to the pair of feed rolls 31, 32 by supplying air under pressure through the air delivery tube 23 to the elongate tube 24. A valve 29 cooperates with the air source 28 and an air supply tube 28*a* so that by use of a button-type switch 29*a* of the valve 29 or the like, i.e., on or off control, the air supply process may be regulated for drawing the yarn Y through the elongate tube 24** during thread-up.

The pair of feed rolls 31, 32 are preferably positioned closely adjacent each other, as best illustrated in FIG. 6 so as to form a nip 34 therebetween. The feed rolls 31, 32 are also preferably positioned downstream from and closely adjacent to output end of the nozzle tube 24'. The pair of feed rolls 31, 32 are further preferably mounted to rotate in opposite directions about respective core shafts 35, 36 having a generally central axis of rotation as illustrated by the directional arrows. Each of the rolls 31, 32 preferably has a respective fluted peripheral portion **31*a*, 32*a*, i.e., gear teeth, positioned to cooperate with the corresponding fluted peripheral portion 31*a*, 32*a*, i.e., gear teeth, of the other roll 31, 32 so that the driving of one roll 32 correspondingly drives the other roll 31**.

The pair of feed rolls 31, 32 is adapted to feed the yarn Y from the yarn source 21 during rotation thereof so that the yarn Y from the yarn source 21 travels through a trumpet member 39 positioned above and between the oppositely rotating rolls 31, 32, preferably at the nip 34, to the rotatable coiler tube 51. The yarn Y from the feed rolls 31, 32 passes or travels therefrom to an air blowing device broadly designated at 70, which is fixedly mounted to the supporting plate 101.

Figure 8:
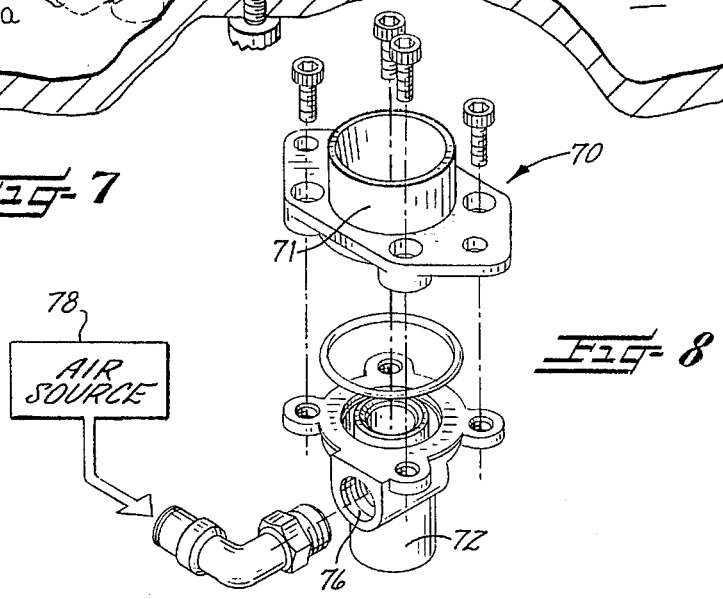
FIG. 8 is an exploded perspective view of the air blowing device of the apparatus.

The air blowing device 70 comprises a guide tube which is composed of interconnected upper and lower sections 71, 72 respectively, and the guide tube includes a venturi-like internal bore which defines a constriction 73 at a medial location along its length. Also, an air supply duct is formed within the device and which includes an annular chamber 74 which surrounds the internal bore, and an annular entrance opening 75 leading from the chamber 74 into the internal bore at the constriction 71. Further, an air delivery duct 76 (FIG. 8) tangentially communicates with the annular chamber 74, and the air delivery duct 76 is connected to an air source 78, which supplies pressurized air to the device at a relatively low pressure of about 10 psi under most operating conditions.

The inlet mouth of the device 70 has a diameter of about one inch, and the delivered air tends to flow downwardly from the constriction 73, thereby creating a partial vacuum below the nip 34 of the feed rolls 31, 32, which facilitates the advance of the yarn. The downward flow of air also passes downwardly through the coiler tube 51 after exhausting from the air blowing device, and thereby facilitates the downward advance of the yarn through the coiler tube 51.

The rotatable coiler tube 51 is composed of adjoining first and second portions. The first portion is mounted for rotation about the vertical axis 54 and is positioned to coaxially receive the lower portion of the air blowing device 70, and extend downwardly therefrom. The second portion is preferably offset from the first portion and also extends in a generally downward direction. The rotatable coiler tube 51 is therefore preferably angled and preferably has a first or upper end 52, a second or lower end 53, and a predetermined angle θ at a bend formed in the tube positioned between the first and second ends 52, 53 thereof (FIG. 5). The angle θ has a preferred range of about 5°–20° for various applications of the invention, but the range may also vary from about 0°–45° for some applications.

The coiler tube 51 preferably has a relatively straight or first portion extending from the first end 52 to the bend and then the second portion extends outwardly in a relatively straight path from the bend as illustrated. Although a predetermined angle θ of about 9° at the bend in the coiler tube 51 is preferred, it will also be understood that other angles, i.e., greater than 45°, and shapes of the coiler tube 51 may also be used such as curvilinear shape or straight shape in some applications. During operation, however, the predetermined angle θ in the coiler tube 51 generally enables the coiler tube 51 to cooperate with the conveyor 90 so that the yarn Y is thrown outwardly in a circular pattern from the rotating coiler tube 51 and to prevent clogging of the yarn Y in the coiler tube 51 such as when the yarn Y is being fed from the pair of feed rolls 31, 32 at a predetermined speed.

A first variable speed drive 40 preferably is connected to the pair of feed rolls 31, 32 and mounted to the horizontal structural plate 101. The first variable speed drive 40 is adapted for rotating the feed rolls 31, 32 at a predetermined speed to facilitate the feeding of the yarn Y from the yarn source 21 to the coiler tube 51. The first variable speed drive 40 preferably includes a first motor 41, such as a variable speed motor mounted on a base plate 41*a* as illustrated, and at least one drive pulley, and preferably a first pair of drive pulleys 42, 43 as illustrated. The first pair of drive pulleys 42, 43 is respectively connected to the motor 41 and at least one of the feed rolls 31, 32. A first drive belt 44 is preferably positioned on the drive pulleys 42, 43 and cooperates with the pair of feed rolls 31, 32 so that driving of the first motor 41 rotates the drive pulley 42 connected thereto, the first drive belt 44 positioned thereon, and the drive pulley connected to the feed rolls 31, 32 to thereby rotate the pair of feed rolls 31, 32 at a predetermined speed.

The first variable speed drive 40 and the feed rolls 31, 32 are preferably mounted on various structural support members as illustrated. One feed roll 32 is mounted along respective ends thereof to a pair of support blocks 111*a*, 112*a* fixedly secured to the supporting plate 101 (FIGS. 5 and 7). Each support block 111*a*, 112*a* has a respective end member 111, 112 of a harness-type member 110 pivotally connected thereto. The first and second end members 111, 112 are positioned along respective ends of the feed rolls 31, 32 and a rod member 113 extends between the end members 111, 112 and forms an outer-restraining end to the harness-type member 110. A fastener 114 secures the rod member 113 into an opening 114*a* in the plate member 101 in an operative position. The fastener 114 preferably includes a bolt having a spring mounted thereon as illustrated. The feed rolls 31, 32 are rotationally mounted on the core shafts 35, 36 which extend therethrough and connect to the respective end members 111, 112. Upon release of the fastener 114, the harness-type member 110 pivots about the support blocks 111*a*, 112*a* to provide access to the inlet mouth of the air flowing device 70.

The coiler 50 also has a second variable speed drive 60, shown in the form of a second motor 61, also preferably a variable speed motor, a mounting flange 65, a second pair of drive pulleys 62, 63 respectively mounted to the second motor 61 and the mounting flange 65, and a second drive belt 64 that cooperates with the pair of drive pulleys 62, 63 as illustrated. The second variable speed drive 60 and the coiler tube 51 likewise are preferably mounted on various structural support members as illustrated. These various structural support members preferably connect to and cooperate with the horizontal structural plate 101 supporting the first variable speed drive 40 and the feed rolls 31, 32. The plate 101 is supported by generally vertical rod members 122, 123, 132, 133 and transverse beam members 121, 131. The transverse beam members 121, 131 cooperate with and are further supported by generally vertical beam members 125, 135 and transverse base members (not shown) or the like. The second motor 61 is preferably mounted to a generally vertical base plate 126 secured to and extending generally perpendicular to the horizontal plate 101. The mounting flange 65 is mounted to the plate member 101 by fasteners which extend through spacer blocks 68 (FIG. 6).

The angled and rotatable coiler tube 51 is preferably positioned in a substantially vertical direction above the conveyor 90 and upstream of the heating oven 80 so that the first end 52 of the coiler tube 51 is adapted to receive the yarn Y from the air blowing device 70. The yarn Y then passes through the angled coiler tube 51 and out of the second end 53 thereof, and impinges on a surface 95 of the conveyor 90. The driving of the second motor 61 drives, i.e., rotates, the drive pulley 62 connected thereto, rotates the second drive belt 64, and rotates the drive pulley 63 which is fixed to a collar 55 which coaxially receives and supports the tube 51. The collar 55 is in turn rotatably mounted to the mounting flange 65 for rotation about the vertical axis 54. The mounting flange 65 includes bearings 66 positioned therein and rotatably cooperates with the collar 55 so that the rotation of the drive pulley 63 connected thereto rotates the coiler tube 51 at the same speed. The collar 55 adjustably cooperates with the coiler tube 51, by use of an adjusting fastener 56, and the mounting flange 65 so that the coiler tube 51 as illustrated may be removed and replaced with other coiler tubes having various other predetermined angles formed therein, smaller or larger sized diameters, or other shapes or orientations as described.

Figure 3:
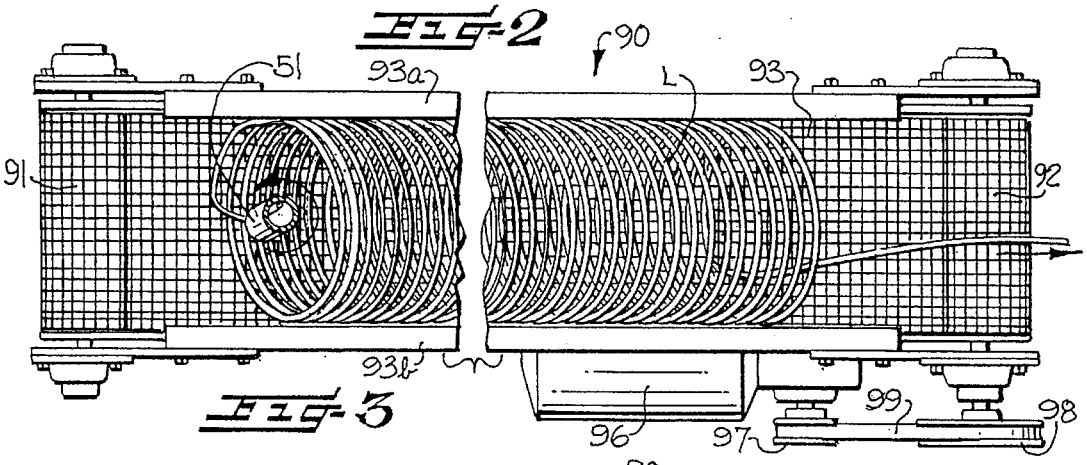
FIG. 3 illustrates a fragmentary top plan view of an apparatus for forming coils of yarn substantially taking the form of a plurality of larger-sized diameter loops of yarn being placed onto a moving conveyor at a first end thereof prior to travel through an enclosed heat setting oven and the loops being taken up on a second end of the conveyor after travel through the enclosed heat setting oven according to the present invention.
Figure 4:
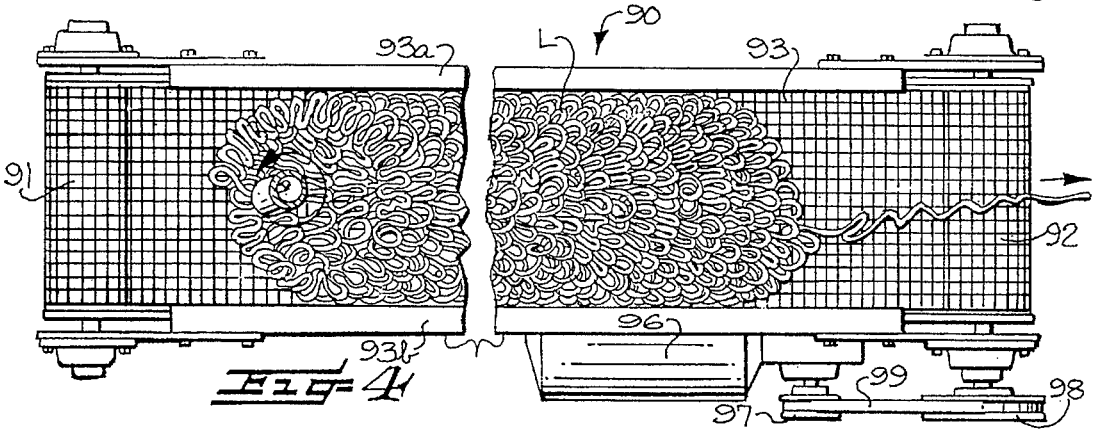
FIG. 4 illustrates a fragmentary top plan view of an apparatus for forming coils of yarn substantially taking the form of a plurality of smaller-sized diameter loops of yarn, i.e., clustered mass, being placed onto a conveyor at a first end thereof prior to travel through an enclosed heat setting oven and the loops being taken up on a second end of the conveyor after travel through the enclosed heat setting oven according to the present invention.

FIG. 3 illustrates the angled coiler tube 51 being rotated at a relatively fast speed so that the yarn Y is thrown out from the angled coiler tube 51 and deposited onto the moving conveyor 90 in relatively larger-sized diameter loops L. FIG. 4 illustrates the angled coiler tube 51 being rotated at a relatively slow speed so that the yarn Y is thrown out from the angled coiler tube 51 and impingingly deposited onto the moving conveyor 90 in relatively smaller-sized diameter loops L. The plurality of smaller-sized loops L of yarn Y are also preferably oriented in a generally larger-sized diameter loop pattern which provides a textured appearance as best illustrated in FIG. 4. The loops L in the yarn Y as described herein will be understood to include a shape or pattern of yarn substantially taking the form of a length of yarn folded over onto itself with an opening positioned therein, as well as other closed or nearly closed shapes or patterns in the yarn.

By providing the combination of these variable speed drives 40, 60 for the coiler 50, for example, in situations where high production output of yarn Y is important, the user of the apparatus 20 can advantageously adjust the feed speed of yarn Y through the coiler 50 to maximize the throughput of the yarn Y on the conveyor 90 into and through the heating oven 80. Also, based on the desired throughput, the user can then adjust the drive speed of the coiler tube 51 to select a predetermined pattern of loops L in the yarn Y. For example, the faster the drive speed of the rotatable coiler tube 51, more larger-sized loops n are formed in the yarn Y. The slower the drive rate of the coiler tube 51, fewer larger-sized loops L and more smaller-sized loops n are formed in the yarn Y.

The conveyor 90, as best illustrated in FIGS. 2–4, includes at least two spaced apart drive rolls 91, 92 and a conveyor belt 93 horizontally extending between and positioned on the drive rolls 91, 92. The conveyor 90 also includes a pair of conveyor guide rails 93*a*, 93*b* that provide a guide for the belt 93 as it travels between the spaced apart drive rolls 91, 92. An upper surface 95 of the conveyor belt 93 receives the loops L of yarn Y relatively upstream (FIG. 2) of the heating oven 80. The rotation of the conveyor drive rolls 91, 92 then feeds the loops L of yarn Y positioned on the conveyor belt 93 to, through, and from the heating oven 80. The conveyor belt 93 feeding the loops L of yarn Y preferably has a widthwise extent of about 9 inches, but as will be understood by those skilled in the art various other sizes of conveyor belts may also be used according to the invention. The apparatus 20 having the series of coilers 50 as illustrated in FIG. 1 preferably has about 7 inches between the series of conveyors 90 and about 16 9/16ths inches from the center of one conveyor 90 to the next.

The conveyor 90 preferably has a motor 96, preferably the third motor of the apparatus 20, mounted positionally below the conveyor belt 93. The motor 96 has a drive pulley 97 mounted thereto. One of the drive rolls 92 also has a drive pulley 98 mounted thereto and a drive belt 99 extends between the pair of drive pulleys 97, 98 so that the motor 96 drives the drive pulley 97 mounted thereto, the drive pulley 97 rotates the drive belt 99, and the drive belt 99, in turn, drives the drive pulley 98 mounted to the drive roll 92. The driving of the drive pulley 98 rotates the drive roll 92 which then drives the conveyor belt 93 generally as illustrated in FIGS. 2–4. The driving of the drive roll 92 having the conveyor belt 93 positioned thereon and cooperating therewith then drives, i.e., rotates, the other drive roll 91 to thereby feed or move the yarn Y positioned on the conveyor belt 93 from the coiler 50 downstream to the heating oven 80 and the yarn take-up means 26. The conveyor 90 is also preferably structurally supported by various generally vertical and transverse structural support members as best illustrated in FIGS. 3–5 and as previously described above.

The angled coiler tube 51 is also preferably positioned in a substantially vertical direction or orientation above the conveyor 90 so that the first end 52 of the angled coiler tube 51 receives the uncoiled yarn Y, the yarn Y passes through the angled coiler tube 51, and yarn received from the second tube end 53 is deposited onto a surface 95 of the conveyor 90. The surface 95 of the conveyor preferably has a textured pattern, such as the crisscross pattern illustrated, so that the yarn Y can easily cooperate with various machinery cooperating therewith, i.e., coiler 50, heating oven 80, yarn take-up means 26 and so that air, gases, or the like can more easily move or circulate around the yarn Y positioned thereon.

The loops L of yarn Y are preferably formed and received on the surface 95 of the conveyor 90 and then fed to the heating oven 80, preferably by the conveyor 90. The yarn heat setting oven 80 is preferably positioned to cooperate with the conveyor 90 and to substantially surround the conveyor belt 93 as it passes through the heating oven 80. The enclosed heating oven 80 is preferably adapted to receive the yarn Y on the conveyor belt 93 through a first opening 81 in the oven 80 (FIG. 2). The conveyor belt 93 feeds the yarn Y through the oven 80, and the yarn Y then passes from a second opening 82 in the oven 80. The yarn Y is conveyed through the heating oven 80 so that the yarn Y is heat set so as to maintain at least some of the predetermined shape therein. The yarn Y is cooled as it leaves the heating oven 80 and is fed to the yarn take-up means 26 for take-up and the individually packaging thereof.

As best illustrated in FIGS. 1 and 2, an apparatus 20 for forming coils of yarn Y and for heat setting the same may also include a plurality of coilers 50 positioned in a generally side-by-side arrangement and a plurality of supply packages 22 of yarn Y. Each of the yarn supply packages 22 is preferably positioned to feed yarn Y to a respective one of the series of coilers 50. A series of conveyors 90 extend generally parallel to each other. Each of the conveyors 90 is preferably positioned vertically below a respective coiler 50, extends a predetermined distance therefrom, and is adapted for receiving loops n of yarn Y thereon. An enclosed heating means, i.e., common heat setting oven 80, is positioned downstream from the series of coilers 50 and receives portions of each of the series of conveyors 90 therein for heating the loops L of yarn Y carried thereon so as to effect heat setting of the yarn Y. Each of the coilers 50 of the series is adapted to form yarn Y received from a yarn supply package 22 into a plurality of loops L of a desired size and preferably have the same structural and functional features as described above herein. The apparatus 20 having the plurality of coilers 50 may share a common heating oven 80, as best illustrated in FIGS. 1 and 2, and may share a common supporting frame.

The apparatus 20 having the plurality of coilers 50 according to the present invention, however, is also preferably adapted so that at least two of the series of rotatable coiler tubes 51 of the coilers 50 are adapted to be variably driven at different desired speeds. This thereby provides an apparatus 20 wherein one of the series of rotatable coiler tubes 51 may be driven at a relatively slow speed responsive to the second variable speed drive 60 connected thereto while forming a clustered mass of relatively small loops n of yarn Y on a corresponding one of the series of conveyors 90 vertically positioned below the slowly rotating coiler tube 51 by impingingly depositing loops L of yarn Y onto the corresponding conveyor 90 at successively closely spaced areas. Also, either the same or a different one of the series of rotatable coiler tubes 51 of the series of coilers 50 may also be driven at a relatively fast speed responsive to the second variable speed drive 60 connected thereto. This allows the coiler 50 to form relatively large loops L of yarn Y on a corresponding one of the series of conveyers 90 vertically positioned below the fast rotating coiler tube 51 with substantially no undulations therein by depositing loops L of yarn Y onto the corresponding conveyor 90 at successively closely spaced areas.

In accordance with the method aspects of the present invention, the yarn Y is advanced along a path of travel from the supply packages 22 to the advancing conveyor belt 90, and so as to include passing the advancing yarn serially (1) between the rotating feed rolls 31, 32 so that the yarn advances downwardly therefrom, (2) through the air blowing device 70 which imparts a downwardly advancing force to the yarn, and (3) through the rotating coiler tube 51. Overlapping loops or coils of the yarn are thereby deposited on the advancing conveyor belt, and the belt is then advanced through the oven 80 to heat set the yarn disposed upon the belt.

The air introduced in the air blowing device 70 passes downwardly through the rotating coiler tube 51 after exhausting from the air blowing device, and thereby assists in the movement and guiding of the yarn from the feed rolls 31, 32 to and through the rotating coiler tube 51. Thus, the yarn is reliably advanced through the rotating coiler tube without risk of jamming in the tube.

The method of the present invention preferably also includes the steps of providing the first variable speed drive 40 connected to the pair of feed rolls 31, 32, providing the second variable speed drive 60 connected to the rotatable coiler tube 51, and rotatingly driving the pair of feed rolls 31, 32 and the coiler tube 51 respectively responsive to the first and second variable speed drives 40, 60 at separately controllable speeds so as to form loops L of yarn Y of a desired size and configuration on the conveyor 90. The second variable speed drive 60 connected to the rotatable coiler tube 51 may rotatingly drive the rotatable coiler tube 51 at a relatively slow speed to thereby form a clustered mass of relatively small loops L of yarn Y on the moving conveyor 90 by impingingly depositing loops L of yarn Y onto the moving conveyor 90 at successively closely spaced areas (FIG. 4). According to this method, an enclosed heating oven 80 is preferably positioned downstream from the coiler tube 51 and adapted to receive portions of the moving conveyor 90 therein (FIG. 2). The clustered mass of relatively small loops L of yarn Y positioned on portions of the moving conveyor 90 is received by the heating oven 80 and heated to thereby effect heat setting of the yarn Y so that the yarn Y emanating from the heating oven 80 has a substantially high degree of undulations therein as effected by the clustered mass of heat set yarn Y. The method also may include the step of rotatingly driving the rotatable coiler tube 51 at a relatively fast speed responsive to the second variable speed drive 60 connected thereto while forming relatively large loops L of yarn Y on the moving conveyer 90 with substantially no undulations therein by depositing loops L of yarn Y onto the moving conveyor 90 at successively closely spaced areas and likewise conveying the loops L of yarn Y to the enclosed heating setting oven 80 to thereby effect heat setting of the yarn Y (FIG. 3). The yarn Y emanating from the heating oven 80 is thereby substantially devoid of any undulations.

Further, as described in the apparatus 20 having the plurality of coilers 50, for example, another method of forming loops L of yarn Y deposited onto the moving conveyor 90 in preparation for heat setting to obtain a desired pattern of undulations according to the present invention is also provided. This method preferably includes the step of rotatingly driving a first rotatable coiler tube at a relatively slow speed responsive to a variable speed drive connected thereto while forming a clustered mass of relatively small loops L of yarn Y on a first moving conveyor by impingingly depositing loops L of yarn Y onto the first moving conveyor at successively closely spaced areas (FIG. 4). The method preferably further includes the step of rotatingly driving a second rotatable coiler tube at a relatively fast speed responsive to a variable speed drive connected thereto while forming relatively large loops L of yarn Y on a second moving conveyer with substantially no undulations therein by depositing loops L of yarn Y onto the second moving conveyor at successively closely spaced areas (FIG. 3). The first and second conveyors also preferably convey the loops L of yarn Y positioned thereon to a common enclosed heat setting oven 80 such as illustrated in FIGS. 1 and 2.

In the drawings and specification, there has been disclosed typical preferred embodiments of the invention and, although specific terms are employed, the terms are used in a descriptive sense only and not for the purposes of limitation. The invention has been described in considerable detail with specific reference to the preferred embodiment. It will be apparent, however, that various modifications and changes can be made within the spirit and scope of the invention as described in the foregoing specification and defined in the appended claims.

That which is claimed is:

1. An apparatus for forming coils of yarn of a predetermined size and comprising:

a supporting frame;

a pair of feed rolls mounted to said supporting frame and arranged to feed yarn in a downward direction from a yarn source;

a rotatable coiler tube positioned adjacent and below said pair of feed rolls, said rotatable coiler tube being vertically positioned and arranged to facilitate the travel of yarn from said feed rolls to and through said coiler tube;

an air blowing device vertically positioned between said feed rolls and said rotatable coiler tube, said air blowing device including a guide tube having an upper portion positioned closely adjacent said feed rolls and a lower portion positioned coaxially within upper confines of said rotatable coiler tube, and an air supply duct communicating with the interior of the guide tube at a medial location along a length thereof and so that the introduced air exhausts from a lower portion of the guide tube and thereby assists in the movement and guiding of the yarn from said feed rolls to and through said rotatable coiler tube;

a first variable speed drive connected to said pair of feed rolls and arranged to rotate said feed rolls at a predetermined speed; and a second variable speed drive connected arranged to rotated said rotatable coiler tube at a speed so as to form a plurality of loops of yarn.

2. The apparatus as defined in claim 1 further comprising a conveyor positioned below said rotatable coiler tube for receiving loops of yarn thereon; and enclosed heating means positioned downstream from said coiler tube and receiving a portion of said conveyor therein for heating the loops of yarn carried thereon so as to effect heat setting of the yarn while in the looped condition.

3. The apparatus as defined in claim 2 wherein said rotatable coiler tube comprises an angled tube having adjoining first and second portions, said first portion being positioned adjacent said feed rolls and extending vertically downward therefrom, said second portion being offset from a vertical direction and extending generally downwardly from said first portion.

4. The apparatus as defined in claim 3 further including pneumatic means for facilitating movement of the yarn from a yarn source to the feed rolls, said pneumatic means including an elongate tube having an input end for receiving yarn from a yarn source and an output end positioned adjacent said pair of feed rolls, and an air jet nozzle operatively connected to said output end of said elongate tube and for supplying for air to said output end so as to advance the yarn through said elongate tube.

5. The apparatus as defined in claim 1 wherein said air blowing device includes a venturi-like interior bore which defines a constriction at a medial location along the length thereof, and wherein said air supply duct includes an annular entrance opening communicating with said interior bore at said constriction.

6. The apparatus as defined in claim 5 further comprising air supply means connected to said air supply duct for supplying air thereto at a pressure of about 10 psi.

7. A method for heat setting a yarn while the yarn is supported in overlapping coils and comprising the steps of advancing the yarn along a path of travel from a yarn supply source to an advancing conveyor belt, and including passing the advancing yarn serially (1) between rotating feed rolls so that the yarn advances downwardly therefrom, (2) through a vertically disposed air blowing device which imparts a downwardly advancing force to the yarn, and (3) through a vertically disposed and rotating coiler tube which forms overlapping loops of the yarn on the advancing conveyor belt retaining the feed rolls and the coiler tube by independent variable speed drives, advancing the conveyor belt through a h setting oven so as to heat set the yarn disposed upon said belt.

8. The method as defined in claim 7 wherein the air blowing device includes a venturi-like internal bore which defines a constriction at a medial location along a length thereof, and wherein the step of advancing the yarn includes introducing pressurized air into the internal bore through an annular opening at said constriction.

9. The method as defined in claim 8 wherein the air blowing device is disposed in coaxial alignment with and immediately adjacent the rotating coiler tube so that the air introduced into said air blowing device passes downwardly through said rotating coiler tube after exhausting from said air blowing device.

10. The method as defined in claim 9 wherein said coiler tube includes a vertically disposed upper portion defining a central axis about which the coiler tube rotates, and a lower portion which is offset from the central axis.

11. The method as defined in claim 10 wherein the step of advancing the yarn further comprises advancing the yarn through a yarn guide tube positioned between said yarn source and said cooperating feed rolls, and wherein said yarn guide tube includes an air jet nozzle for advancing the yarn through said yarn guide tube and toward the feed rolls.

12. The method as defined in claim 7 comprising the further step of separately controlling the rotational speed of said feed rolls and the rotational speed of said coiler tube, so as to control the configuration of the overlapping loops formed on the conveyor belt.

* * * * *

UNITED STATES PATENT AND TRADEMARK OFFICE

CERTIFICATE OF CORRECTION

PATENT NO. : 5,475,907

DATED : December 19, 1995

INVENTOR(S) : Hoover

It is certified that error appears in the above-indentified patent and that said Letters Patent is hereby corrected as shown below:

Title page, item [73], Assignee

"American Line Corporation" should be --American Linc Corporation--.

Title page, item [56], References Cited

Patent No. "4,785,510" should be --4,735,510--.

The date for Patent No. 4,817,880 "4/1988" should be --4/1989--.

Title page, item [57], Abstract

Line 3, "ant" should be --and--.

Column 7, line 33, after loops, "n" should be --L--;

line 36, after loops, "n" should be --L--.

Column 8, line 49, after loops, "n" should be --L--.

Column 9, line 3, after loops, "n" should be --L--.

Column 10, line 65, between "connected" and "arranged" please insert --and--;

line 66, "rotated" should be --rotate--.

UNITED STATES PATENT AND TRADEMARK OFFICE

CERTIFICATE OF CORRECTION

PATENT NO. : 5,475,907

DATED : December 19, 1995

INVENTOR(S) : Hoover

It is certified that error appears in the above-indentified patent and that said Letters Patent is hereby corrected as shown below:

Column 11, line 23, delete "for" second occurrence.

Column 12, line 7, "retaining" should be --rotating--;
line 8, after "drives," please insert --and--;
line 9, "h" should be --heat--.

Signed and Sealed this

Fourteenth Day of May, 1996

*Attest:*

Bruce Lehman

BRUCE LEHMAN

*Attesting Officer*

*Commissioner of Patents and Trademarks*